US006161495A

United States Patent [19]

Ambs

[11] Patent Number: 6,161,495

[45] Date of Patent: Dec. 19, 2000

[54] POWER STORAGE FOR MARINE SEISMIC VESSEL

[75] Inventor: Loran Ambs, Fulshear, Tex.

[73] Assignee: Western Atlas International, Inc, Houston, Tex.

[21] Appl. No.: 09/285,219

[22] Filed: Apr. 1, 1999

[51] Int. Cl.[7] ..... B63G 8/08; B63G 8/40; B63H 21/22

[52] U.S. Cl. ..... 114/337; 114/336; 440/1

[58] Field of Search ..... 114/312, 336, 114/337; 440/4, 1, 6

[56] References Cited

U.S. PATENT DOCUMENTS

| | | | |
|---|---|---|---|
| 2,247,595 | 7/1941 | Besler | 60/6 |
| 4,309,620 | 1/1982 | Bock | 290/4 R |
| 4,625,823 | 12/1986 | Frank | 180/165 |
| 5,568,023 | 10/1996 | Grayer et al. | 318/139 |
| 5,721,461 | 2/1998 | Taylor | 310/268 |

*Primary Examiner*—Mark T. Le
*Assistant Examiner*—Patrick Craig Muldoon
*Attorney, Agent, or Firm*—Alan J. Atkinson

[57] ABSTRACT

A marine vessel having backup power storage in the event of primary power source failure. The invention applies to different marine vessels and is particularly suited to vessels used in marine seismic operations. A rotating mass energy storage provides stored energy which can be distributed to the vessel following primary power source failure. A pulsed generator charges the energy storage means, and the pulsed generator can comprise a homopolar generator or a compensated pulsed alternator. The primary power source can recharge the energy storage means, and a sensor and controller can control different functions related to the control and operation of the primary power source and the energy storage means

5 Claims, 1 Drawing Sheet

POWER STORAGE FOR MARINE SEISMIC VESSEL

BACKGROUND OF THE INVENTION

The present invention relates to the field of power systems for marine vessels and is especially useful for marine seismic exploration vessels. More particularly, the invention relates to a secondary power source for storing large quantities of energy and for selectively discharging such energy when a primary power source for the vessel is inoperative.

Seismic exploration methods indicate the physical properties and spatial disposition of geologic formations underlying the earth surface. In land based seismic systems, mechanical vibrators or explosive charges initiate a pressure wave in earth materials. In marine systems, a seismic source array comprising air guns or other pressure source wave generators are towed by a vessel through the water. Source waves from a seismic source travel downwardly through the subsurface formations, and portions of the seismic wave energy are reflected, refracted and transmitted by geologic interfaces between subsurface geologic units. The returning reflected waves are detected by a sensor or sensor arrays located at a known position relative to the energy source. In marine seismic operations, the reflected waves are detected with towed sensors such as hydrophones or bottom cables positioned on the ocean floor.

Seismic sensors in marine systems comprise transducers which convert pressure, velocity or acceleration into electric signals. The output signals are recorded and processed to indicate mechanical, acoustic and structure characteristics of geologic units. For example, the propagation time of a seismic wave reflected from a point is proportional to the depth of the reflection point. Travel times from multiple, spatially diverse source and receiver pairs facilitate construction of maps representing the spatial disposition of subsurface geologic units.

Towed vehicles are typically neutrally buoyant and depend on water flow over control surfaces to maintain position in the water. If the tow vehicle should lose forward motion, the tow vehicle is uncontrolled and may sink. Such event can damage towed arrays and can sink the tow vehicle and the tail buoy marking the array tail-end. Even if the equipment does not sink, the submerged tow vehicle and towed array will comprise a navigation hazard.

Numerous vessel propulsion systems have been developed for marine vessels, including gasoline engines, diesel engines, electric motors, and jet propulsion units as the primary sources of power. Secondary power sources permit vessel operation following failure of the primary power source. Otherwise, power failure can lead to irretrievable loss of the vessel, towed equipment and data acquired by the vessel. Existing secondary power sources for marine vessels typically comprise storage batteries such as silver/zinc batteries or auxiliary fuel-powered propulsion systems. Battery power sources are heavy and require recharge time and maintenance. Auxiliary power systems are subject to the same failure mechanisms experienced by the primary power sources, and may not provide reliable auxiliary power. Conventional batteries and conventional generators provide relatively low storage density for secondary power requirements. Accordingly, a need exists for an improved apparatus for storing and discharging large amounts of energy. The apparatus should be portable and should be capable of sustaining energy discharge over a defined time interval.

SUMMARY OF THE INVENTION

The invention provides a marine vessel having a hull and a propulsion system for moving the hull through water. The vessel includes a primary power source for engaging and for transferring energy to the propulsion system to move the hull through water, and a rotating mass energy storage means engaged with the propulsion system for storing energy and for selectively discharging said energy to operate the propulsion system.

In different embodiments of the invention, a pulsed generator charges the energy storage means, and the pulsed generator can comprise a homopolar generator or a compensated pulsed alternator. The primary power source can recharge the energy storage means, and a sensor and controller can control different functions related to the control and operation of the primary power source and the energy storage means.

BRIEF DESCRIPTION OF THE DRAWING

The drawing illustrates a schematic diagram of a marine vessel having a primary power source and a secondary energy storage.

DESCRIPTION OF THE PREFERRED EMBODIMENTS

Figure 1:
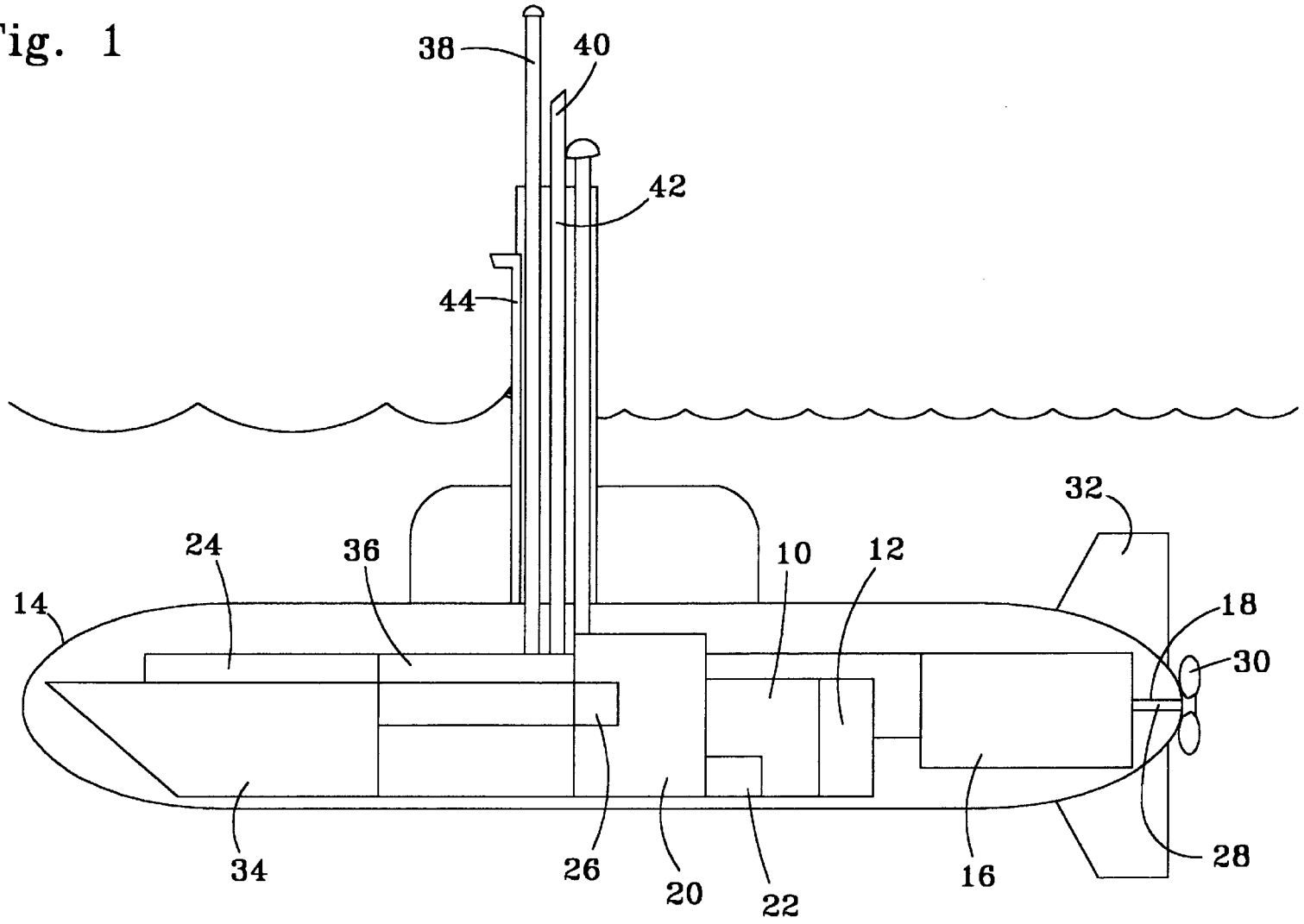

Streamer arrays used in marine seismic exploration produce significant hydrodynamic drag acting against the tow vessel. Seismic streamer arrays between four and eight kilometers in length create between 2,000 to 5,000 pounds of drag at about five knots.

The invention provides an alternative energy source for maintaining vessel speed in the event of primary power failure. Depending on the array configuration, a modest speed between one and two knots should prevent sinking and should provide adequate steering control. Assuming one hundred horsepower is required to pull 4000 pounds of drag at five knots, ten horsepower could pull the same equipment at a speed of about 1.6 knots. Although the original velocity is not maintained, the reduced propulsive power would provide control to the tow vehicle and towed arrays.

If the primary energy supply ceases operation, the uninteruptible propulsion system of the invention is activated to supply motive force to keep the tow vehicle and towed arrays under control at a reduced power output. The energy required to produce ten horsepower for thirty minutes is 13.4 megajoules. In one embodiment of the invention which stores energy in a rotating mass, a solid cylindrical mass of 500 kg having a radius of 0.25 meter rotating at 1000 rpm has a specific energy approximating 170 w-hr/kg. Rotating the same mass at 2000 rpm produces a specific energy approximating 685 w-hr/kg. Rotating the same mass at 3000 rpm produces a specific energy approximating 1542 w-hr/kg. By selecting the mass, radius and rotational frequency, an energy storage device can be designed for specific applications and energy requirements for a marine vessel.

The invention is particularly advantageous over conventional storage devices having limited energy storage capabilities. A lead-acid battery can store specific energy in the range between 25–35 w-hr/kg, an advanced lead-acid battery can store between 35–40 w-hr/kg, a nickel-metal hydride battery can store between 50–60 w-hr/kg, a lithium-ion battery can store between 80–90 w-hr/kg, and a lithium-polymer battery can store approximately 100 w-hr/kg. As demonstrated by these storage capabilities, the invention is capable of storing significantly more energy than chemical storage devices in the same mass and volume because the energy density of the storage is significantly greater.

The invention provides a high-powered pulsed generator as an energy storage mechanism or signal generator for a marine vessel. As used herein, the term "pulsed generator" includes homopolar generators, compensated pulsed generators, and other forms of rotating mass energy storage devices. A pulsed generator provides multiple functions of storing energy and of discharging such energy. One form of pulsed generator uses passive compensation where a continuous conducting shield is at rest relative to the field excitation. The static exciting field diffuses through the shield and induces a voltage in the spinning armatures. The alternator may include a stationary, rotating, or counter-rotating compensating coil, and numerous configurations of such pulsed generator devices exist.

One embodiment of the invention uses compensated pulsed alternators as the pulsed generator because such devices can be designed to produce hundreds of pulses per second or to produce a single pulse similar to a homopolar generator. Pulsed generators can be operated in series or in parallel. The invention is particularly suited for seismic exploration but is also applicable to other marine vessels where failure of the primary power supply was undesirable. The term "water" means all applications having water as a mass for supporting a vessel hull and includes open water, marshes, tidal regions, rivers, estuaries, and man-made impoundments.

Referring to the drawing, a schematic diagram for one embodiment of the invention is illustrated. A pulsed generator such as compulsator 10 is illustrated as being engaged with a converter shown as transducer 12. Transducer 12 is engaged with vessel hull 14 and converts the energy discharged from compulsator 10 into an energy form capable of transmission to the electric motor 16. Transducer 12 is positioned between hull 14 in contact with a selected propulsion means such as drive train 18. A primary power source such as engine 20 is also engaged with drive train 18 for providing the power to move hull 14.

Drive motor 22 provides energy to recharge compulsator 10 after energy has been discharged from compulsator 10, and controller 24 can be engaged with compulsator 10 to manage the energy discharge and recharge. Sensor 26 can detect the operation of primary power source 20 and can generate a signal for transmission to controller 24. Using input from sensor 26, controller 24 may dynamically modify the output of compulsator 10 and of transducer 12 to produce the desired energy discharge.

Drive train 18 can comprise shaft 28 and propeller 30 or can comprise jets, compressed air discharge ports, ballast or flotation controls, or other types of systems. Such systems can move hull 16 vertically, horizontally, laterally, or axially within the water. Rudder 32 can provide steering control, and controller 24 can be integrated with the working components of the vessel.

The drawing illustrates a marine vessel adapted to seismic operations wherein hull 14 is independently moveable in the water. Fuel tank 34 provides storage for primary power source 20, radio/modem 36 is engaged with antenna 38, and UPS 40 and exhaust 42 are integrated within mast 44 which extends above the water surface.

A pulsed generator such as compulsator 10 can comprise a high power electric storage device and signal shape generator suitable for transmitting energy to electric motor 16. Compulsator 10 can comprise an electric generator having one or more phases which produce an alternating current, and this current is transmitted over the period represented by the discharge of energy from compulsator 10.

Compulsator 10 is capable of storing significantly more energy in less weight and space than electrical capacitor banks or batteries. Consequently, the energy density of compulsator 10 is extremely high as significant energy is stored per unit volume of space. In addition to the energy storage density, pulsed generators produce very high current of long duration and relatively low voltage compared to the high electric potential of short duration delivered by capacitor based energy storage systems. The rotating mass energy storage provided by compulsator 10 also eliminates the toxic hazards associated with the use and disposal of conventional batteries.

Homopolar generators store energy in the inertial form of a spinning rotor or flywheel. Electrical contacts such as brushes slide at high speed on the outer periphery and axial shaft of the rotor to collect the generated current. Homopolar generators store inertial energy in the rotor/flywheel as the rotational velocity of the rotor/flywheel is increased. A homopolar or pulsed generator converts inertial energy into electric energy which is dissipated in the form of heat and work by a converter such as electric motor 16. As current begins to flow through the rotor and brushes, Lorenz forces decelerate the rotor and the stored kinetic energy is converted to one or more electric pulses to provide a secondary power source for hull 14.

Solid copper-graphite brushes have been developed to conduct electrical currents ranging up to hundreds of thousands of amps, and compulsators have been developed with a power density above 1000 kW/kg. Pulsed generators have been used to weld metal, power solid state lasers, and fire electromagnetic guns. Other compulsator applications include simulation of micro-meteorites impacting space vehicles, sintering operations, hypervelocity spraying of dense metal coatings, and the ignition of lean mixtures in automobile engines, however compulsators have not been used for secondary energy supply storage in vessels.

The construction of various compulsators and compulsator improvements is described by U.S. Pat. No. 4,200,831 to Weldon et al. (1980), in U.S. Pat. No. 4,841,217 to Weldon et al. 1989), in U.S. Pat. No. 4,858,304 to Weldon et al. (1989), in U.S. Pat. No. 4,935,708 to Weldon et al. (1990), in U.S. Pat. No. 5,530,309 to Weldon (1996), the disclosures of which are incorporated herein by reference, and by other sources.

Pulse generators are commercially available from Parker Kinetic Designs, Inc. of Austin, Tex., and are available in representative sizes ranging between 6.7 megajoules ("MJ") at 1.5 MA and 60 MJ at 1.5 MA. A 10 MJ homopolar generator has an effective capacitance of 2,000 farads, a peak discharge current of 1,500,000 amps, and maximum terminal voltage of 100 volts DC. A 60 MJ device has equivalent series capacitance of 333 farads, equivalent parallel capacitance of 12,000 farads, peak discharge current of 9,000,000 amps, and maximum open terminal voltage of 600 volts DC. A 60 MJ device comprises six pulsed power supplies which can be connected to a common bus system to furnish the capability to interconnect individual generators and to form various parallel and series combinations. Drive motor power is provided by a common 2400 horsepower high pressure hydraulic system.

The invention provides a unique system for providing power to remote vehicles, and eliminates the need for heavy batteries conventionally used in power back-up systems. The absence of large storage batteries eliminates environmental problems associated with leaking batteries and hazardous disposal issues. The invention reliably provides high current, long lasting secondary power for maintaining minimal vessel speed and control following loss of a primary power source.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A marine vessel having a hull and a propulsion system for moving the hull through water, comprising:

a primary power source for engaging and for transferring energy to the propulsion system to move the hull through water, a rotating mass energy storage means engagable with the propulsion system for storing energy and for selectively discharging said energy to operate the propulsion system following failure of said primary power sources, a pulsed generator for charging said rotating mass energy storage means; and, wherein said pulsed generator comprises a compensated pulsed alternator or a homopolar generator.

2. A vessel as recited in claim 1, further comprising a sensor for detecting cessation of energy transfer from said primary power source to the propulsion system.

3. A vessel as recited in claim 1, further comprising a controller engaged with said energy storage means, wherein said controller is capable of operating said energy storage means when said primary power source ceases power transfer to the propulsion system.

4. A vessel as recited in claim 1, further comprising a controller engaged with said energy storage means, wherein said controller is capable of managing the discharge rate of energy from said energy storage means to the propulsion system.

5. A vessel as recited in claim 1, further comprising a controller engaged with said energy storage means, wherein said controller is capable of reducing the hull speed to a level sufficient to prevent sinking of the hull.

* * * * *